US011898307B2

(12) United States Patent
Yener et al.

(10) Patent No.: US 11,898,307 B2
(45) Date of Patent: Feb. 13, 2024

(54) ENVIRONMENTALLY DYEING PROCESS FOR CELLULOSIC PRODUCTS

(71) Applicant: BURSALI TEKSTIL SANAYI VE TICARET ANONIM SIRKETI, Bursa (TR)

(72) Inventors: Eyüphan Yener, Bursa (TR); Güzin Akyol, Bursa (TR)

( * ) Notice: Subject to any disclaimer, the term of this patent is extended or adjusted under 35 U.S.C. 154(b) by 184 days.

(21) Appl. No.: 17/635,790

(22) PCT Filed: Aug. 25, 2020

(86) PCT No.: PCT/TR2020/050764
§ 371 (c)(1),
(2) Date: Feb. 16, 2022

(87) PCT Pub. No.: WO2021/040662
PCT Pub. Date: Mar. 4, 2021

(65) Prior Publication Data

US 2022/0290368 A1 Sep. 15, 2022

(30) Foreign Application Priority Data

Aug. 27, 2019 (TR) ..... 2019/12917

(51) Int. Cl.

| | |
|---|---|
| ***D06P 1/00*** | (2006.01) |
| ***D06P 1/34*** | (2006.01) |
| ***D06M 16/00*** | (2006.01) |
| ***D06P 1/50*** | (2006.01) |
| ***D06P 1/66*** | (2006.01) |
| ***D06P 3/60*** | (2006.01) |
| *D06L 1/06* | (2006.01) |

(52) U.S. Cl.
CPC ..... *D06P 1/34* (2013.01); *D06M 16/006* (2013.01); *D06P 1/50* (2013.01); *D06P 1/66* (2013.01); *D06P 3/6041* (2013.01); *D06L 1/06* (2013.01)

(58) Field of Classification Search
CPC ..... D06P 1/34; D06P 1/50; D06P 1/66; D06P 3/6041; D06P 1/645; D06P 1/6491; D06P 1/6533; D06P 1/6536; D06P 1/655; D06P 3/60; D06P 3/6008; D06P 1/0032; D06M 16/006; D06M 2200/50; D06M 16/003; D06L 1/06; D06L 1/14
USPC ..... 8/646
See application file for complete search history.

(56) References Cited

U.S. PATENT DOCUMENTS

| | | | | |
|---|---|---|---|---|
| 2005/0155634 | A1* | 7/2005 | Lillotte | D06L 4/40 134/42 |
| 2012/0309077 | A1* | 12/2012 | Sachdev | D06L 1/12 435/263 |
| 2016/0319224 | A1* | 11/2016 | Lant | D06M 15/227 |

FOREIGN PATENT DOCUMENTS

| | | | | |
|---|---|---|---|---|
| CN | 101349020 | A | 1/2009 | |
| CN | 103437141 | A * | 12/2013 | D06B 3/18 |
| CN | 106638053 | A | 5/2017 | |
| JP | H06192978 | A | 7/1994 | |

OTHER PUBLICATIONS

International Search Report for corresponding PCT/TR2020/050764, dated Jan. 27, 2021.
Written Opinion of the International Searching Authority for corresponding PCT/TR2020/050764, dated Jan. 27, 2021.
Tsatsaroni E et al., "Effect of Enzymatic Treatment on the Dyeing of Cotton and Wool Fibres with Natural Dyes", Dyes and Pigments, Elsevier Applied Science Publishers Barking, GB,vol. 29, No. 3, Jan. 1, 1995 (Jan. 1, 1995), p. 203-209.

* cited by examiner

*Primary Examiner* — Eisa B Elhilo
(74) *Attorney, Agent, or Firm* — Egbert, McDaniel & Swartz, PLLC

(57) ABSTRACT

Disclosed is an environmentally friendly method that enables the pre-treatment and dyeing processes applied to cellulosic products used in the production of textile products such as towels, bathrobes to be carried out in a single bath with natural, biological preparations.

7 Claims, No Drawings

ENVIRONMENTALLY DYEING PROCESS FOR CELLULOSIC PRODUCTS

TECHNICAL FIELD

The invention is related to an environmentally friendly method that enables the pre-treatment and dyeing processes applied to cellulosic products used in the production of textile products such as towels, bathrobes to be carried out in a single bath with natural, biological preparations.

PRIOR ART

In recent years, with the consumers turning to natural products in parallel with the increase in environmentally friendly activities, the consumption of natural products in a broad range from food to textiles is increasing at the same rate. With the development of environmental consciousness, the positive and negative contributions of the raw materials used in the production stages of the products, to nature as well as their aesthetic features are being effective in determining the demands and preferences of the consumers.

The process of turning cellulosic material such as cotton fiber into a finished textile material for towel production consists of many processes and stages. Said processes and stages consist of pre-treatment, dyeing and finishing processes consisting of producing the woven or knitted fabric followed by desizing, hydrophilization, bleaching after spinning the cotton fiber into yarn.

In the current art, many harmful chemicals such as wetting agent, ion immobilizer, stabilizer, caustic, hydrogen peroxide, acetic acid, anti-peroxide enzymes are generally used in pre-treatment processes of cotton products and this process takes place in three different baths in three steps. In the first step including hydrophilization, desizing and bleaching processes, although the process is carried out at high temperatures (98° C.), chemicals such as wetting agent, ion immobilizer, stabilizer, caustic and hydrogen peroxide are used. In the second step, the excess of these harmful chemicals is removed by hot water, by rinsing at 90° C. and at the last stage, the fabric is neutralized with acetic acid and the peroxide chemical which may remain on the fabric is removed with the anti-peroxide enzyme. With the completion of the pre-treatment process, it is ensured that a white appearance is obtained by purifying the oil, wax, dirt on the cotton. Then, in another new step and bath, dyeing process is carried out with salt, soda, acetic acid and reactive dyestuff groups. The chemicals used in these said processes create some disadvantages both in the production process and for the environment and conscious users.

In textile pre-treatment, it is necessary to select the materials used in treatment processes, to be made consciously and carefully in order to reduce the environmental burden and to carry out an environmentally friendly production. Since the use of these chemicals cannot be completely eliminated, at least it is necessary to prefer more environmentally friendly, more compatible materials and new technologies. Additionally, with the pre-treatment applied in the conventional process, the materials on the cotton which provide the beneficial and natural softness (self-touch) are removed from the cotton. This situation not only decreases the strength of the cotton but also causes softening finishing to be given in order to provide touch during the finishing processes. The permanence of the softener given with finishing is limited to only 10-15 washes.

In order to eliminate these negativities mentioned in the current applications, especially environmentally friendly enzymes have been started to be used intensively in the dyeing preparation processes of cotton woven fabrics and combined process development studies have been carried out. The enzymes generally used in pre-treatment of cotton and cotton blend materials are amylase, protease, cellulase, pectinase, lipase, catalase and laccase. These enzymes are used to for providing the effects of desizing, hydrophilization, softening, bio-polishing in the material.

After the pre-treatment process is completed, cotton products are contacted with dye chemicals such as azo, carbonyl, cyanine, di- and triphenylmethane and phthalocyanine which contain chromophore groups creating the color by placing them into a different bath for dyeing process after rinsing with water. Wastewater generated during the dyeing process may contain heavy metals and they may show carcinogenic effect. This situation damages both human and environmental health and the textile products subjected to dyeing process. In addition to all of these, problems such as high pH, high oxygen demand, difficult working conditions and high costs are frequently encountered.

Consequently, due to the aforementioned negativities and deficiencies, there has been a need to make an innovation in the related technical field.

AIM OF THE INVENTION

The present invention is related to an environmentally friendly dyeing process for cellulosic products which meets the above-mentioned requirements, eliminates all disadvantages and brings some additional advantages.

The main aim of the invention is to perform the pre-treatment and dyeing process of cellulosic products in a single bath by using natural, biological preparations.

The aim of the invention is to present a process that provides permanent touch and ensures the environmental waste load colored with natural dyes to be at the minimum level.

The aim of the invention is to dye the cellulosic product subjected to the pre-treatment process with natural dye by using cationizing agent. The ionicity of cotton products, which is anionic, becomes cationic with the addition of cationizing agents and thus, the interest of the cotton product to the anionic natural dyestuff is increased. As a result of this, the possibility of using less dyestuff is provided.

The aim of the invention is to provide that specific enzymes and cationizing agents are bonded with natural dyestuffs in the same bath by combining in the appropriate pH range while ensuring that the beneficial substances on cellulosic products remain thereon.

An object of the invention is to provide water and energy saving by performing the pre-treatment and dyeing process in a single bath.

An object of the invention is to minimize the use of harmful chemicals by removing substances such as ion immobilizer, stabilizer, anti-peroxide enzyme, caustic, acetic acid, hydrogen peroxide.

Another object of the invention is to dye towels with an environmentally friendly method which is not hazardous for environment.

Another object of the invention is to reduce labor requirement for production, to increase the production rate.

In order to achieve the abovementioned aims, the invention is a method that enables the pre-treatment and dyeing processes applied to cellulosic products used in the production of textile products such as towels, bathrobes to be carried out in a single bath, wherein said method comprises the following steps;

heating the water to 60° C. located in said bath, placing the cellulosic product into the heated water bath and adding a wetting agent to ensure that the product is wetted homogeneously, preparing the pre-treatment bath by adding the mixture of amylase, cellulase, pectinase and cationizing agent prepared by pre-mixing, treating the cellulosic product in a bath with a pH value of 6-6.5 for 45 minutes, after the pre-treatment process is completed, adding to the same bath the natural dyestuffs and mordant substances allowing the dyestuff to be bonded with the cellulosic product, performing a dyeing process by increasing the temperature to 95° C.

The structural and characteristic features and the entire advantages of the invention will be understood more clearly thanks to the detailed description given below, and therefore the evaluation should be made by taking this detailed description into consideration.

DETAILED DESCRIPTION OF THE INVENTION

In this detailed description, the environmentally friendly method that enables the pre-treatment and dyeing processes applied to cellulosic products used in the production of textile products such as towels, bathrobes to be carried out in a single bath with natural, biological preparations, is disclosed only for better understanding of the subject and without creating any restrictive effect.

Formulation of the Pre-Treatment Bath Used in the Method of the Invention

| Content | Preferred Amount By Weight (%) | Usable Amount by Weight (%) |
|---|---|---|
| Wetting agent | 1.5 | 1-2.5 |
| Amylase | 0.5 | 0.5-1 |
| Cellulase | 0.15 | 0.1-0.5 |
| Pectinase | 5 | 4-7 |
| Cationizing agent | 1.5 | 1-2 |
| Water | 91.35 | 87-93.4 |

The method that enables the pre-treatment and dyeing processes applied to cellulosic products used in the production of textile products such as towels, bathrobes to be carried out in a single bath is carried out as follows;

Water is poured into the bath and heated to 60° C.,

Cellulosic product is placed into the heated water bath and a wetting agent is added to ensure that the product is wetted homogeneously, Then, the pre-treatment bath is prepared by adding amylase, cellulase, pectinase and cationizing agent, which were previously mixed in a container, The cellulosic product is treated in a bath with a pH value of 6-6.5 for 45 minutes, After the pre-treatment process is completed, the natural dyestuffs and mordant substances allowing the dyestuff to be bonded with the cellulosic product are added to the same bath, the dyeing process is carried out by increasing the temperature to 95° C.

While the cellulosic product is homogeneously wetted with the wetting agent used in the method of the invention, amylase, cellulase, pectinase and cationizer substances to be added in the next process step are allowed to properly penetrate into the product.

As a result of the studies conducted, the optimum time for pre-treatment and dyeing processes applied to cellulosic products was determined to be 45 minutes and the temperature to be 60° C. The desired yield cannot be achieved in pre-treatment processes performed below 60° C. Therefore, the dyeing to be performed following the pre-treatment process cannot be performed properly. Also, an efficient result cannot be obtained in pre-treatment processes if the treatment time is less than 45 minutes. It is provided that dyestuff is penetrated into fabrics better by increasing the temperature to 95° C. in the dyeing process.

The wetting agent is a non-ionic surface active agent and provides that the other substances (cationizing agent and enzymes) composing the pre-treatment bath are better penetrated into the cellulosic product surface.

Amylase removes the starch size on the cellulosic product. It is a natural, cheap and readily available enzyme substance.

Cellulase is used to hydrolyze cellulose in cellulosic product structure, to smooth the fabric surface, to reduce pilling tendency, and also performs the function of bio-polishing.

Pectinase provides hydrophilization of the cellulosic product by removing the pectin in the cellulosic product structure.

The anionic ionicity of cellulosic products becomes cationic with the cationizing agent. Thus, the possibility of using less dyestuff is provided by increasing the interest of the product to anionic dyestuff. The negative load accumulation is observed on the surface of all fibers after the cellulosic products are immersed in an aqueous environment. Therefore, the use of anionic dyestuffs in dyeing of cellulosic products tends to repel each other with this negative load that occurs on the surface and the dyeing process becomes difficult. In the preferred embodiment of the invention, quaternary ammonium salts, triethanol amine hydrochloride, dimethylol dihydroxy ethylene urea, methylol hydroxy ethylene urea or choline chloride can be used as the cationizing agent.

Mordant substances used in the dyeing process step are biodegradable (ecological) substances and have no adverse effects on the environment and human health. Mordant substances used in the preferred embodiment of the invention are individuals or their combinations selected from the group consisting of tannic acid, vinegar and lemon.

The negative loads accumulated on cellulosic products are converted into positive loads thanks to the cationizing agent. As a result of this, it is ensured that cellulosic product surfaces are dyed with natural dyestuffs by changing the load accumulation on the surface. Fixation of natural dye to the cationized product becomes easier. In the preferred embodiment of the invention, pine extract, turmeric, hibiscus, walnut shell, pomegranate peel or onion extract can be used as natural dyestuff.

During the pre-treatment process, impurities such as oil, wax, dirt etc. on the cellulosic product (raw cotton) are removed while the better affinity of natural dyes into to the fabric is provided by opening chemical bonds in the structure of cotton with cationization process.

In the method of the invention, since all processes take place in a single bath, the pH value should be 6-6.5. When these values are exceeded, the efficiency of pre-treatment and cationization processes decreases, and dyeing inefficiency also occurs. Therefore, in the method of the invention, substances that can cooperate with each other in suitable pH ranges were used. Optimum running pH ranges were determined as a result of trial studies. As a result of all these studies, the common running pH value of 6-6.5 for a single process were determined in optimum pH ranges of each substance.

The invention claimed is:

1. A method for pretreatment and dying applied to a cellulosic product used in a production of textile products carried out in a single bath, the method comprising:

heating water in the single bath to 60° C.;

placing the cellulosic product into the heated single water bath;

adding a wetting agent to the cellulosic product in the heated single water bath such that the cellulosic product is wetted homogenously;

pre-mixing amylase, cellulase, pectinase and a cationizing agent into a premixture;

adding the premixture to the heated single water bath;

treating the cellulosic product in the single bath at a pH value of 6.0 to 6.5 for forty five minutes;

adding a natural dye stuff and a mordant substance to the single bath after the step of treating such that the natural dyestuff is bonded to the cellulosic product; and continuing dyeing by increasing a temperature of the single bath to 95° C.

2. The method of claim 1, wherein the single bath has 87% to 93.4% water, 1% to 2.5% wetting agent, 0.5% to 1% amaylase, 0.1% to 5% cellulose, 4% to 7% pectinase and a 1% to 2% cationizing agent.

3. The method of claim 1, wherein the canonizing agent is selected from the group consisting of quaternary ammonium salts, triethanol amine hydrochloride, dimethylol dihydroxy ethylene urea, methol hydroxyl urea and choline chloride.

4. The method of claim 1, wherein the natural dyestuff is selected from the group consisting of pine extract, turmeric, hibiscus, walnut shell, pomegranate peel and onion extract.

5. The method of claim 1, wherein the mordant substance is selected from the group consisting of tannic acid, vinegar, lemon and combinations thereof.

6. A towel obtained by the method of claim 1.

7. A bathrobe obtained by the method of claim 1.

* * * * *